United States Patent [19]

Dewsnap et al.

[11] 4,146,411

[45] Mar. 27, 1979

[54] HOT BAR COOLING

[75] Inventors: Ronald F. Dewsnap; David E. Beard, both of Sheffield, England

[73] Assignee: British Steel Corporation, London, England

[21] Appl. No.: 868,056

[22] Filed: Jan. 9, 1978

[51] Int. Cl.[2] ..... C21D 1/78; C21D 7/14

[52] U.S. Cl. ..... 148/12 B; 148/12.4; 148/39

[58] Field of Search ..... 148/12 B, 12.4; 148/39

[56] References Cited

U.S. PATENT DOCUMENTS

| | | | |
|---|---|---|---|
| 2,756,169 | 7/1956 | Corson et al. | 148/12.4 |
| 3,111,436 | 11/1963 | McGavin | 148/143 |
| 3,711,338 | 1/1973 | Vitelli | 148/12 B |
| 3,756,870 | 9/1973 | Kasper et al. | 148/12.4 |
| 4,016,009 | 4/1977 | Economopoulos et al. | 148/12 B |
| 4,065,329 | 12/1977 | Paulus et al. | 148/12.4 |

FOREIGN PATENT DOCUMENTS

| | | |
|---|---|---|
| 1047637 | 11/1966 | United Kingdom. |
| 1392269 | 4/1975 | United Kingdom. |
| 1467625 | 3/1977 | United Kingdom. |
| 1472111 | 5/1977 | United Kingdom. |

*Primary Examiner*—W. Stallard

*Attorney, Agent, or Firm*—Bacon & Thomas

[57] ABSTRACT

A steel rod or bar comprises an outer surface layer of ferrite-pearlite type structure, an annulus immediately below said surface layer having an acicular micro-structure comprising martensite and/or bainite and a core of bainite or martensite or ferrite and carbides or a combination of two or more of these constituents.

10 Claims, 5 Drawing Figures

Figure 1:
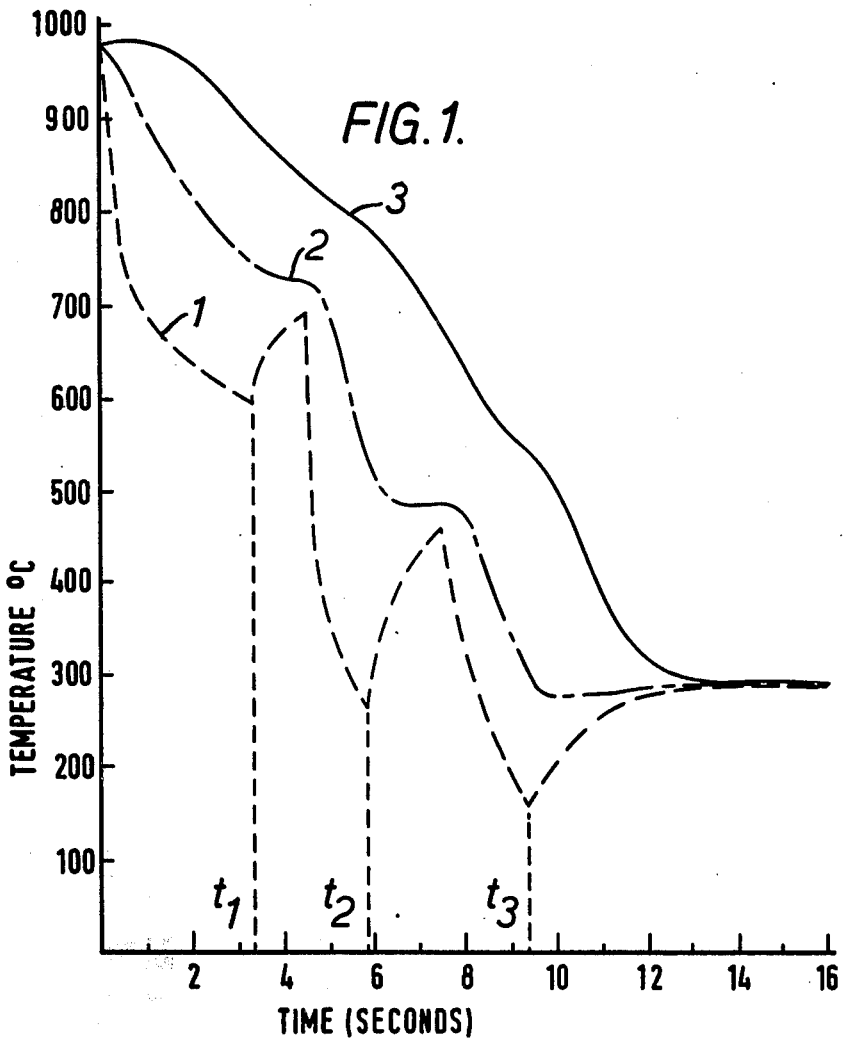

1000
900
800
700
600
500
400
300
200
100
TEMPERATURE °C
2
4
6
8
10
12
14
16
TIME (SECONDS)
1
2
3
$t_1$
$t_2$
$t_3$

MARTENSITE OR BAINITE
FERRITE AND PEARLITE
BAINITE OR FERRITE AND CARBIDES

HOT BAR COOLING

This invention relates to hot rolled steel rod or bar and to a method of producing the same.

A process is known in which rod or bar is superficially quenched as it exits from the finishing stand of a rolling mill, to produce a bainitic or martensitic surface layer around an austenitic core; subsequent cooling of the rod or bar transforms the core to ferrite and carbides, heat transferred from the core tempering the surface layer.

In certain applications the stress corrosion or rod or bar having a bainitic or martensitic surface layer may be inadequate. Such applications include anchor, rods required to lie in contact with soil containing contaminants such as sulphates, nitrates and chlorides or reinforcing bar to be embedded in concrete containing such contaminants. A microstructure of ferrite/pearlite is known to have better stress corrosion resistance than tempered martensite.

According to the present invention in one aspect a process for producing steel rod or bar includes the sequential steps of rolling stock to size in a hot rolling mill, partially quenching the rolled or or bar to lower its surface to a temperature at which a ferrite-pearlite type transformation occurs without lowering the temperature of the core of the bar or rod to a value below the critical temperature for austenite transformation, holding the rod or bar at this temperature for a period of time sufficient to produce a surface layer of ferrite-pearlite type structure, rapidly quenching the partially cooled rod or bar to lower its surface temperature to produce an acicular micro-structure comprising martensite and/or bainite annulus interposed between the surface layer and the still austenitic core and subsequently cooling the rod or bar so as to transform the austenitic core either to ferrite and carbides or to bainite or to martensite or to a combination of two or more of these constituents.

The rod or bar may be quenched by water sprayed on to its surface as it travels from the hot rolling mill or by passing the rod or bar through quenching apparatus, e.g. a trough, containing a turbulent flow of water. Air cooling may be adopted for higher alloy steels. Alternatively, the rod or bar may be cooled by means of an air/water mist directed onto its surface or by being passed through a bath of liquid metal (e.g. lead) or aqueous solution (e.g. brine).

According to the present invention in a further aspect, a hot rolled steel rod or bar comprises an outer surface layer of ferrite-pearlite type structure, an annulus immediately below said surface layer having an acicular micro-structure comprising martensite and/or bainite, and a core of bainite or martensite or ferrite and carbides or a combination of two or more of these constituents. A bainitic annulus may be interposed between the martensitic annulus and the core.

A ferrite-pearlite transformation is one in which a pearlite or ferrite divorced pearlite structure is formed.

Figure 2:
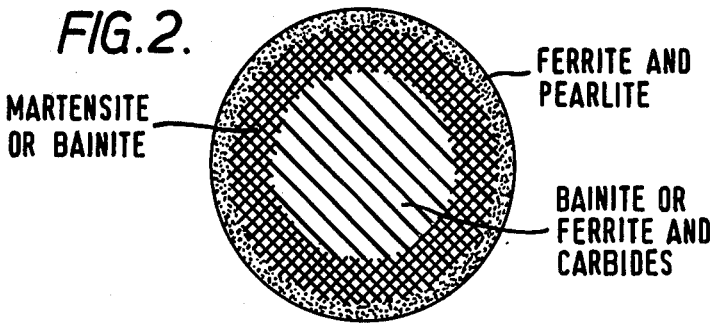
Figure 3:
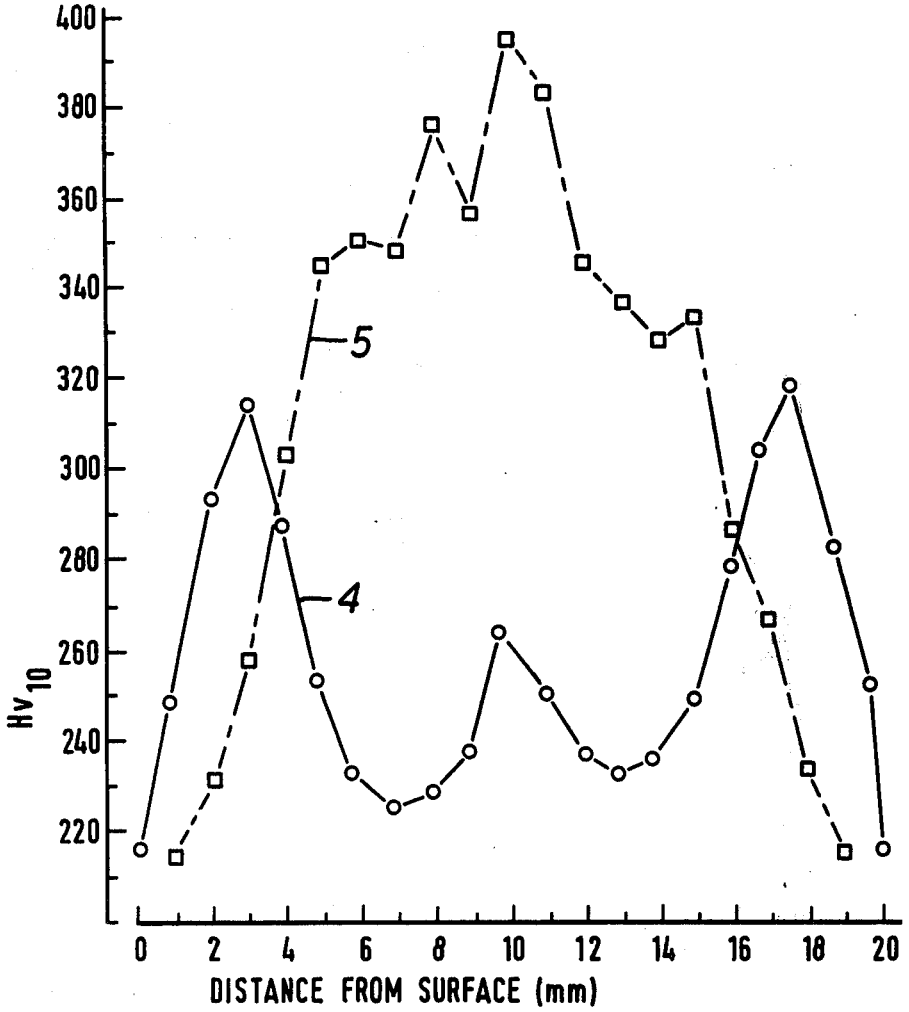
Figure 4:
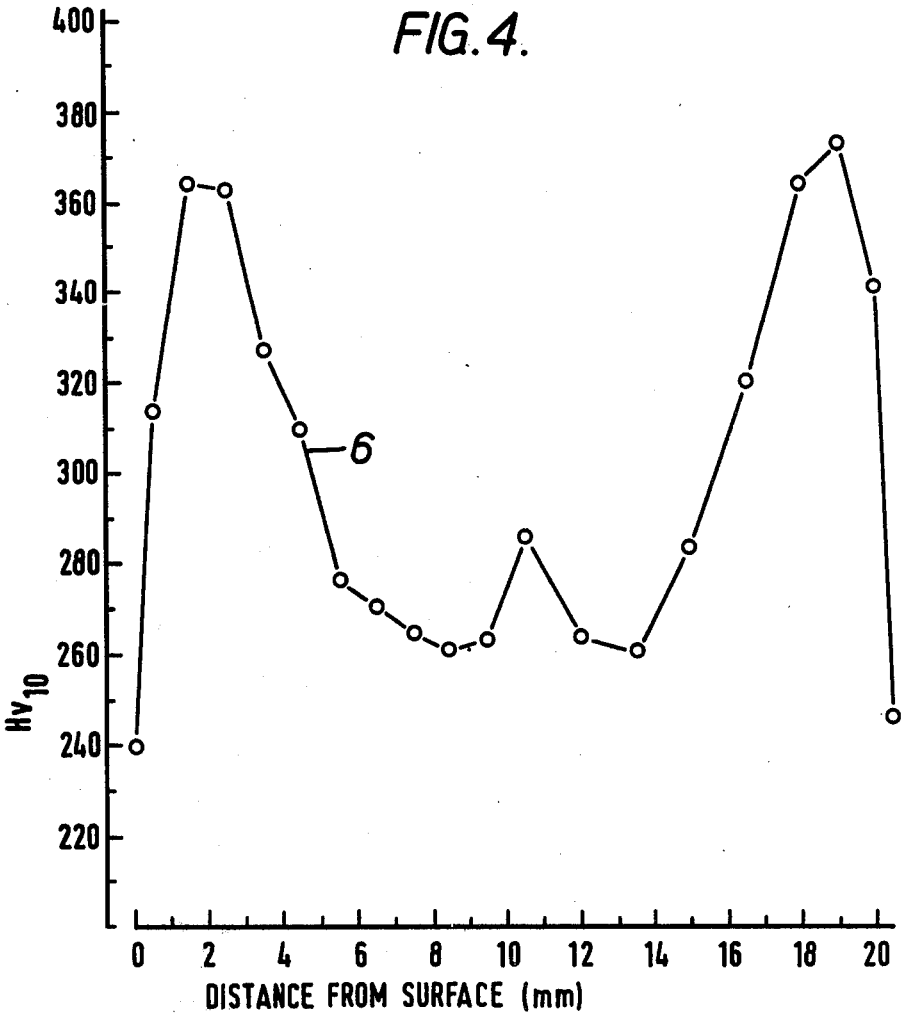
Figure 5:
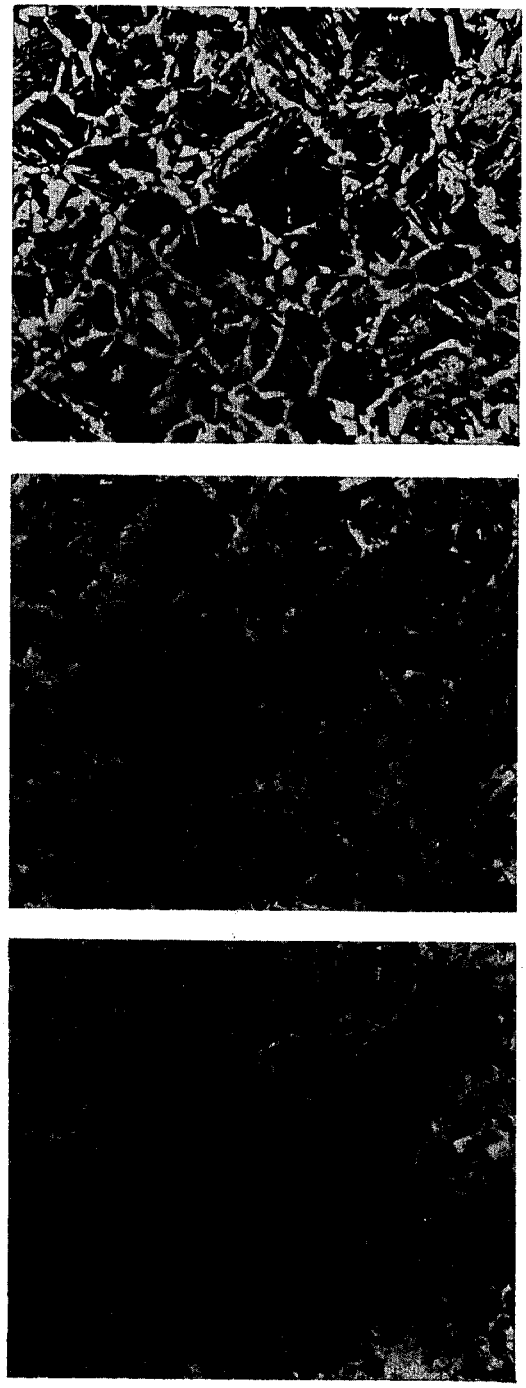

The invention will now be described by way of example with reference to the accompanying drawings, in which:

FIG. 1 graphically illustrates cooling curves taken at three locations across the width of round steel bar produced in accordance with this invention;

FIG. 2 illustrates a cross-section of bar produced in accordance with the invention, FIGS. 3 and 4 graphically illustrate hardness profiles produced across bars produced in accordance with the invention, and FIG. 5 shows three micro-structures across the bar whose hardness profile is illustrated in FIG. 4.

The cooling curves graphically illustrated in FIG. 1 plot temperature in ° C. against time in seconds, and indicate the temperatures existing at the surface of a bar, immediately below the bar surface and at the core of the bar at various times throughout a cooling cycle carried out to simulate experimentally conditions to be experienced by a hot rolled bar leaving the finishing stand of a hot rolling mill. The curves are respectively indicated by reference numerals 1, 2 and 3.

The bar used in the experiment was a typical reinforcing bar of 20mm diameter having a composition by weight percentage of 0.21 carbon, 0.62 manganese 0.06 sulphur, 0.012 phosphorous, 0.02 silicon and balance iron and incidental impurity.

The bar was heated to a temperature of approximately 980° C. and then partially quenched for a period of 3.3 seconds in a lead bath at a temperature of 400° C. to lower the bar surface temperature to approximately 600° C. to encourage pearlite transformation. At the conclusion of this quench (time $t_1$ as indicated on the horizontal axis of the graph) the temperature of the core of the bar remained above the critical temperature for transformation of austenite.

The surface layer of the bar was held in the pearlite transformation temperature range for a period of approximately 1 second (time $t_2$) by air cooling to form a pearlite-ferrite micro-structure within the surface layer. In an alternative arrangement the pearlite transformation temperature conditions can be maintained through intermittent water cooling of the bar, e.g. by intermittent jetting or by passing the bar through a succession of water troughs. On conclusion of this cooling stage the surface layer may also include a minor content of bainite.

Once the required surface layer was formed the bar was rapidly quenched by immersion in a brine solution for a further period of 1.5 seconds, air cooled and then once again rapidly quenched by immersion in a brine solution for a period of 1.5 seconds to cool the bar down to a temperature at which both the surface layer and the intermediate layer lay below that at which martensite is formed (time $t_3$). At this time the temperature at the bar surface was approximately 180° C., that at a location 3mm below the bar surface approximately 280° C. and that at the bar centre approximately 500° C. These two rapid quenches produced an annulus of martensite immediately below the surface layer consisting predominantly of pearlite.

Following the quenching stages the bar achieved an equalisation temperature in air of approximately 300° C.; during this air cooling heat emanating from the core tempered the intermediate layer of the bar and the core transformed to a combination of ferrite, carbides and bainite.

For different sizes and grades of rod and bar, the cooling times and temperature ranges quoted above will differ. In each case, however, the curve 2 will always lie above the critical transformation temperature before time $t_2$.

The hardness profile across the bar produced in the above described experiment is illustrated in FIG. 3. This hardness profile is shown in full line and is indicated by reference numeral 4. As will be seen from FIG. 3 the bar was found to have a relatively soft pearlite surface layer of between 210 and 220 $H_v10$ hardness, an acicular micro-structure comprising martensite and bainite just below the surface of approximately 320 $H_v10$ hardness and a relatively soft core comprising bainite carbides and ferrites having a hardness of approximately 260 $H_v10$.

Also illustrated in FIG. 3 is a hardness profile of a bar of the same diameter and composition to that described above but subjected to a modified cooling cycle. The hardness profile for this bar is shown in chain dotted line in FIG. 3 and is indicated by reference numeral 5. The cooling cycle for this second bar included an initial quench for a period of six seconds in a lead bath held at a temperature of 450° C., followed by air cooling for 1 second and rapid quenching in a brine bath at −10° C. for four seconds. The bar produced by this cooling cycle was found to have a similar surface layer hardness to that described previously, but differed in that the intermediate layer just below the surface layer, had a hardness of approximately 350 $H_v10$ and in that the bar core had a hardness approaching 400 $H_v10$. Thus, while the bar indicated by the hardness profile 4 had a relatively soft surface layer, a hard intermediate layer and a relatively soft core, the bar indicated by hardness profile 5 had a relatively soft surface layer, a harder intermediate layer and a relatively hard core.

FIG. 4 illustrates a hardness profile 6 of a bar the same composition in diameter to those described above, but cooled by multiple immersions in aqueous solutions of town water and brine. From this Figure it will be seen that the bar exhibits a similar hardness profile to profile 4 of FIG. 3. FIG. 5 shows micro-structures across the bar whose hardness profile is illustrated in FIG. 4. The micro-structures are taken at the surface of the bar and at locations 2mm below the bar surface and at the bar centre. This micro-structure clearly illustrates a ferritic-pearlite micro-structure at the bar surface, an acicular micro-structure comprising martensite and bainite in the layer just below the surface and a micro-structure at the core consisting of ferrite, carbides and bainite.

It is to be understood that by suitable selection of the quenching media and quenching times, it is possible to achieve a range of different micro-structures across the width of a bar.

As shown diagrammatically in FIG. 2, rods or bars produced in accordance with the above described process are characterised by an outer surface layer consisting essentially of pearlite and ferrite, an inner annulus of martensite or bainite and a core of bainite or of ferrite and carbides or a mixture thereof. Such rod or bar has the advantages of maintaining the stress corrosion resistance of a pearlitic reinforcing bar with the additional advantages of increased strength and improved ductility.

In rolling hot bar a dynamic situation exists in the bar immediately after the final deformation in which the austenite recrystalises. This is followed immediately by grain growth. The fine recrystalised grains tend to transform at a temperature of around 600° to 700° C. very rapidly to produce a pearlite-type micro-structure. Thus if the surface of a bar is cooled to a temperature corresponding to that at which a ferrite-pearlite type transformation takes place the above described reaction is accelerated. In time the austenite stabilises as a result of grain growth thereby promoting martensite formation just below the bar surface. In applying the present invention in a hot bar mill situation it is consequently preferably to immediately quench the bar as it emerges from the mill.

It is to be understood that the processes described above are applicable to a wide range of steel compositions. However, principally they are applicable to the production of plain carbon-manganese type steel rods or bars in which the austenite stability allows transformation to ferrite-pearlite at the bar surface in a short period of time while having sufficient stability to transform to martensite-bainite in the sub-surface layer.

We claim

1. A process for producing steel rod or bar including the sequential steps of rolling stock to size, partially quenching the rolled rod or bar to lower its surface to a temperature at which a ferrite-pearlite type transformation occurs without lowering the temperature of the core of the rod or bar to a value below the critical temperature for austenite transformation, holding the rod or bar at this temperature for a period of time sufficient to produce a surface layer of ferrite-pearlite type structure, rapidly quenching the partially cooled rod or bar to lower its surface temperature to produce an annulus of acicular micro-structure comprising martensite and/or bainite interposed between the surface layer and the still austenitic core and subsequently cooling the rod or bar to transform the austenitic core to ferrite and carbides, or to bainite, or to martensite, or to a combination of two or more of these constituents.

2. A process as claimed in claim 1 wherein the initial partial quench is effected by spraying water onto the surface of the bar as it leaves a hot rolling mill.

3. A process as claimed in claim 1 wherein the initial partial quench is effected by passing the bar through a trough containing coolant.

4. A process as claimed in claim 2 wherein the coolant is liquid lead.

5. A process as claimed in claim 2 wherein the coolant is water.

6. A process as claimed in claim 2 wherein the coolant is brine.

7. A process as claimed in claim 1 wherein the initial partial quench is effected by directing air jets at the surface of the bar as it leaves a hot rolling mill.

8. A process as claimed in claim 1 wherein the rapid quench is effected by immersing the partially cooled bar in an aqueous solution.

9. A process as claimed in claim 1 wherein rapid quenching is achieved by subjecting the partially cooled bar to a succession of quenching stages, each separated by a short period during which the bar is air cooled.

10. A steel rod or bar comprising an outer surface layer of ferrite-pearlite type structure, an annulus immediately below said surface layer having an acicular micro-structure comprising martensite and/or bainite and a core of bainite or martensite or ferrite and carbides or a combination of two or more of these constituents.

* * * * *